US005328116A

United States Patent [19]

Hishinuma

[11] Patent Number: 5,328,116

[45] Date of Patent: Jul. 12, 1994

[54] REGULATED LENGTH TAKE-UP DEVICE

[75] Inventor: Toru Hishinuma, Tokyo, Japan

[73] Assignee: Nikka Kabushiki Kaisha, Tokyo, Japan

[21] Appl. No.: 897,427

[22] Filed: Jun. 12, 1992

[51] Int. Cl.[5] ..... B65H 18/12

[52] U.S. Cl. ..... 242/543; 242/538

[58] Field of Search ..... 242/67.5, 67.1 R, 67.2, 242/67.3 R, 67.4

[56] References Cited

U.S. PATENT DOCUMENTS

| | | | |
|---|---|---|---|
| 1,108,619 | 8/1914 | Poland | 242/67.2 |
| 1,172,733 | 2/1916 | Raber | 242/67.5 |
| 1,688,444 | 10/1928 | Wheelbarger | 242/67.5 |
| 4,344,361 | 8/1982 | MacPhee et al. | 101/425 |
| 4,372,697 | 2/1983 | Babcock | 242/67.5 X |

FOREIGN PATENT DOCUMENTS

| | | | |
|---|---|---|---|
| 1314173 | 12/1989 | Japan | 242/67.5 |

*Primary Examiner*—John M. Jillions

*Attorney, Agent, or Firm*—Oliff & Berridge

[57] ABSTRACT

A regulated length take-up device characterized by its substantially reduced width to be compact and simple structure, offering accurate regulated length take-up operation. A rotating lever is connected to the shaft of a take-up roll via a one-way clutch. Connected to the rotating lever is a cylinder mechanism which allows the take-up roll to rotate for the take-up operation along with the cylinder pull-in action. A sensor lever 32 capable of oscillating in accordance with variations in the take-up diameter of the take-up roll, is disposed in a manner that the orbit of the oscillation of the sensor lever agrees with the direction of the stroke of the cylinder mechanism. Along with a stopper disposed on the sensor lever to face the restoring action of the rotating lever, a cam curvature portion is formed on the rotating lever so that the cylinder stroke is constrained to keep constant the take-up length at every position over the orbit of the stopper regardless of variations of the take-up diameter of the take-up roll.

9 Claims, 3 Drawing Sheets

REGULATED LENGTH TAKE-UP DEVICE

BACKGROUND OF THE INVENTION

The present invention is directed to a regulated length take-up device, and, more particularly, is directed to the appropriately structured, regulated length take-up device which is suitably applied to an instrument which feeds continually washing cloth by a regulated length for the purpose of blanket cylinder washing operation in a printing machine.

In offset printing, a blanket cylinder is usually washed in order to remove residual inks and paper powder each time a predetermined amount of printed sheets is outputted. When a washing apparatus wipes the blanket cylinder by means of washing cloth, the washing cloth fed by a washing cloth feeder roller travels past a pressure block and is taken up by a take-up roll. The take-up roll continually takes up the washing cloth by a regulated length.

In the prior art regulated length take-up device described above, consideration is given to taking up a regulated length of the cloth, aimed at its efficient use. Variations of the take-up diameter of the take-up roll make it impossible to achieve regulated length take-up. Various techniques have been devised to cope with this. For example, a technique disclosed by Japanese Unexamined Patent Application No. 1-314173 (disclosed in Dec. 19, 1989) has, on a take-up roll shaft, a lever which is urged by an air cylinder to carry out take-up operation. Disposed on the other side of the lever, i.e., opposed to the air cylinder, is a stopper integrated with a detector block which moves in response to variations of the take-up diameter of the take-up roll, in a manner that the stopper is capable of being in contact with the lever; the washing cloth is taken up until the lever driven by the air cylinder contacts the stopper. In the apparatus proposed by the disclosure, the contact face of the lever against the stopper has a curvature configuration which allows the stroke of the air cylinder to be controlled in a manner that a fixed take-up length is achieved at each position of the stopper which shifts in response to variations of the take-up diameter of the take-up roll. The disclosure claims that the regulated length take-up operation is achieved by varying the cylinder stroke in accordance with the change of the take-up roll diameter.

Such a prior art regulated length take-up device described as above fails to accurately measure the take-up roll diameter under slippage and friction which incur between the rod of the air cylinder and the take-up lever, and between a stopper pin and its pin receiver, when the air cylinder drives the lever. The air cylinder, the take-up lever driven by the air cylinder and the diameter detector block share the common line of action (a straight line), and this line is perpendicular to the longitudinal axis of the take-up roll. The overall width of the take-up device of this kind is usually, mainly determined by the layout of both the washing cloth feeder roll and the take-up roll; if the structure of the air cylinder extends substantially the width of the take-up roll, however, the width of the device must be wide enough to accommodate the required stroke of the cylinder.

SUMMARY OF THE INVENTION

It is an object of the present invention to provide a regulated length take-up device which achieves accurate regulated length take-up operation with the driving force of a take-up mechanism not affecting the take-up diameter detector mechanism.

It is a further object of the present invention to provide a regulated length take-up device which is compact and simple structure with reduced overall device width.

The regulated length take-up device, preferably applied to the washing apparatus of a blanket cylinder in a printing machine, comprises a rotating lever mounted on the rotation shaft of a take-up roll by means of a one-way clutch, take-up driving means connected to the rotating lever to cause the take-up roll to rotate for take-up operation, a sensor lever disposed around the take-up roll along its tangential direction, capable of oscillating according to variations of the take-up diameter of the take-up roll, stroke constraint means made of a stopper disposed on the sensor lever and a cam curvature portion diametrically opposed to the stopper on the rotating lever, the cam curvature portion constraining the take-up stroke of the rotating lever in response to the variations of the take-up diameter of the take-up roll so that the take-up length is kept constant in each position of the stopper in its orbit, wherein the cam curvature portion is so designed that the stationery holding force of the cylinder at each contact portion of the cam curvature portion with the stopper is transferred to the axis of oscillation of the sensor lever, and the cam curvature portion touching the stopper is formed of a curvature which is substantially perpendicular to a line segment connecting each contact point of the cam curvature portion to the axis of oscillation of the sensor lever so that take-up rotation of the rotating lever is transferred to the axis of oscillation of the sensor lever.

According to the above arrangement, the take-up operation of sheet material is performed by rotating the rotating lever driven by the take-up driving means; after taking up a regulated length of sheet material, the take-up driving means is restored back to its original position. The rotating means rotates the rotating lever, but up to the position where the cam curvature portion of the rotating lever touches the stopper. A take-up stroke is defined as a distance between this stop position and the travel limit of the take-up driving means, and is determined by a gap between the cam curvature portion and the position of the stopper. The sensor lever with the stopper oscillates in accordance with the take-up diameter of the take-up roll, and adjusts its stopper position, referenced to the take-up diameter. The cam curvature portion is so configured that the take-up length is kept constant at every position of the orbit of the stopper regardless of variations in the take-up diameter, the above-mentioned gap presents the required take-up stroke to the take-up driving means.

In the above arrangement, when the take-up driving means is stopped by the stopper, the force derived from the take-up driving means is transferred to the axis of the sensor lever. Detection of the take-up diameter depends on the oscillation motion, no force is transferred from the oscillation driving means to the detection position, and thus, force which would dent the lamination of sheet material wound does not take place. Thus, accurate detection of the take-up diameter is performed. The line of action of the take-up drive means differs, in direction, from the line of transmission of force of the stroke constraint means including the stopper; thus, more freedom is provided in mounting the take-up driving means, allowing the take-up driving means to be mounted toward the feeder roll which is opposed to the take-up roll. Therefore, the overall width of the regulated length take-up device is substantially reduced.

DESCRIPTION OF THE PREFERRED EMBODIMENTS

Figure 1:
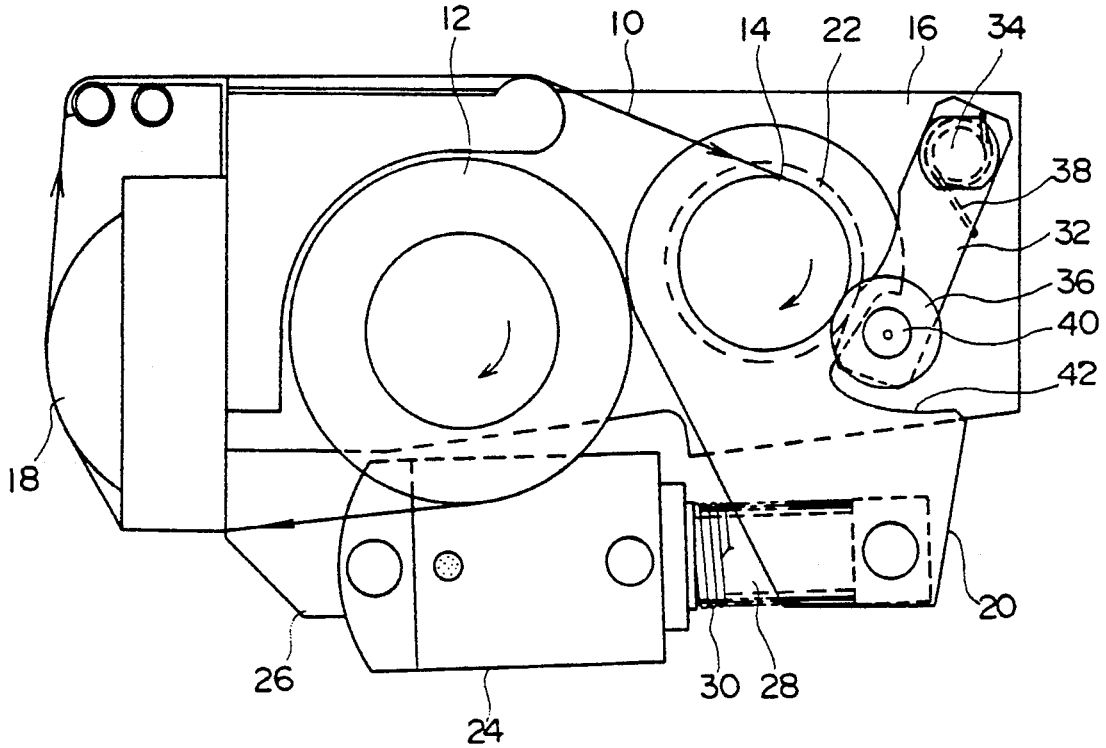
FIG. 1 is a side view of the regulated length take-up device according to an embodiment of the present invention.

Referring now to the drawings, the embodiment of the present invention is described in detail below.

Figure 2:
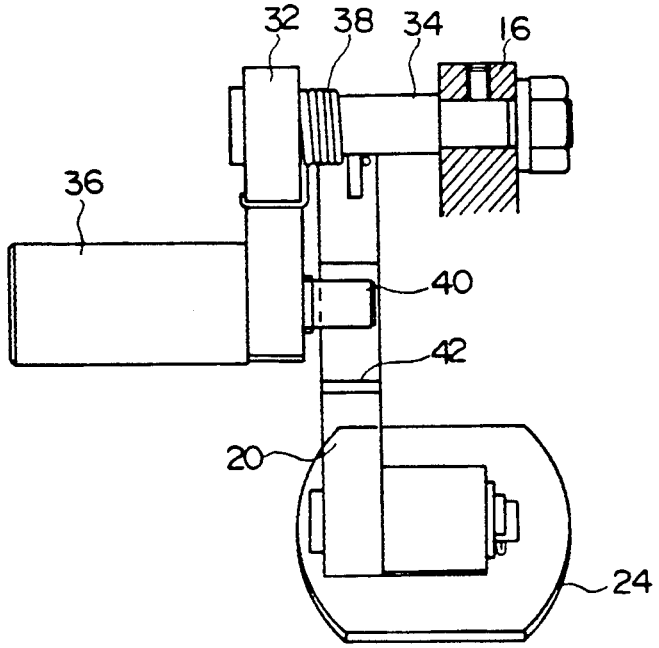
FIG. 2 is a front view of the regulated length take-up device.

FIG. 1 and FIG. 2 are respectively the side view and the front view of the regulated length take-up device according to the embodiment of the present invention. Presented here is the example in which the regulated length take-up device is incorporated in a blanket cylinder washing apparatus. Both a feeder roll 12 with unused washing cloth 10 around it and a take-up roll 14 are supported at their axes on both sides by the support plates 16 in a manner that both rolls remain parallel with each other. In FIG. 1, the washing cloth 10 is supplied from underside of the feeder roll 10, travels past the pressure block 18 disposed on the front end of the device (on the left hand side in the figure), and is then taken up by the take-up roll 14 disposed on the rear end of the device. The take-up roll 14 rotates clockwise to perform the take-up operation in FIG. 1.

Figure 3:
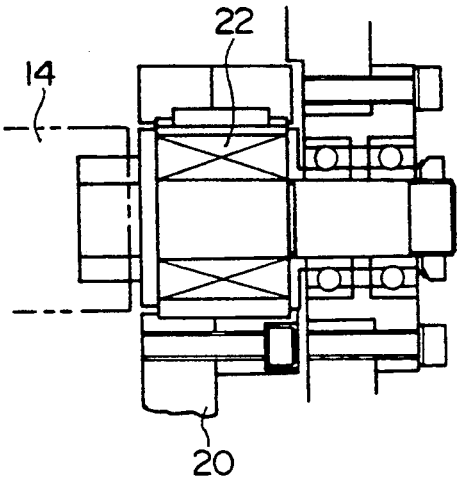
FIG. 3 is a partial cross-sectional view showing the rotating lever of the regulated length take-up device.

Further to the above arrangement, the rotating lever 20 is connected the shaft end of the take-up roll 14 in a manner that allows axial connection between the rotating lever 20 and the take-up roll 14 by means of the one-way clutch 22 as in FIG. 3. When the rotating lever 20 rotates in the take-up direction (clockwise direction in FIG. 1), rotation is transferred to the take-up roll 14, and when the rotating lever 20 rotates in the reverse direction, the take-up roll 14 is disconnected. The rotating lever 20, made of a flat plate extending downward from the bossing of the take-up roll 14, has, on its bottom end portion, an air cylinder 24 as a driver for rotation.

Figure 5:
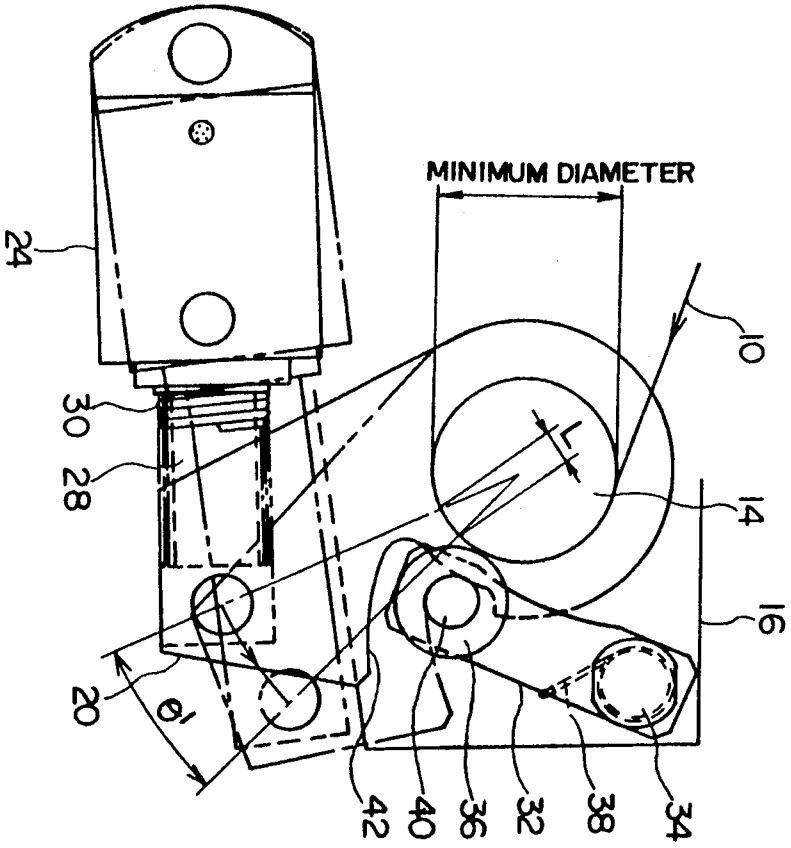
FIG. 5 shows the regulated length take-up device with its take-up roll diameter set to a minimum.
Figure 6:
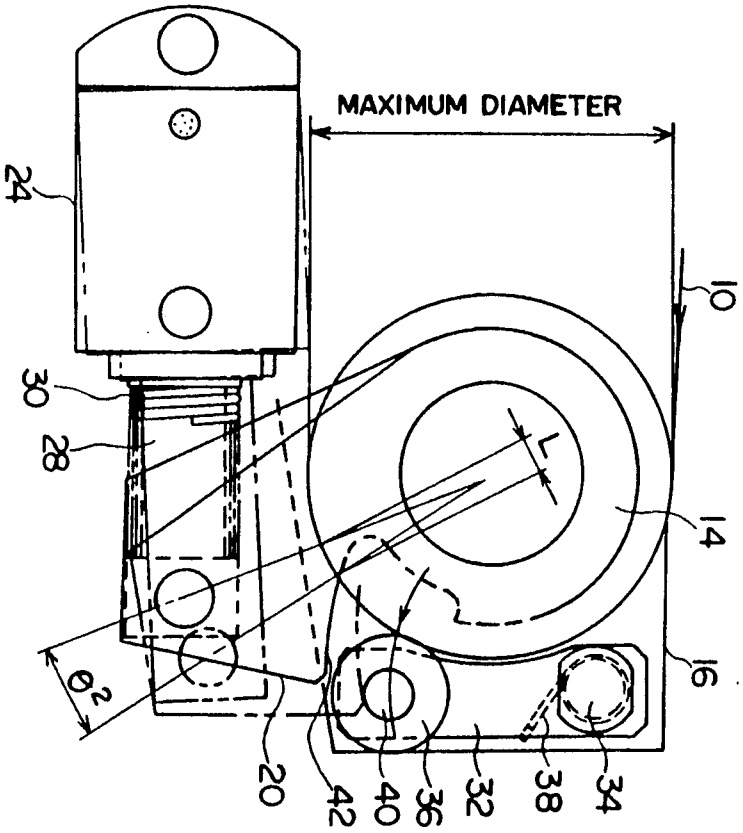
FIG. 6 shows the regulated length take-up device with its take-up roll diameter set to a maximum.

The air cylinder 24 is arranged toward the feeder roll 12, and secured to a bracket 26 which is mounted on the lower bottom edge of the rotating lever 20. The rod 28 of the air cylinder 24 is connected to the bottom end of the rotating lever 20. The cylinder rod 28 has a compression coil spring 30, and the compression coil spring 30 urges the cylinder rod 28 in a manner that allows the cylinder rod 28 to project outward. With no load applied to the air cylinder 24, the cylinder rod 28 is pushed out, causing the rotating lever 20 connected to it, to rotate counterclockwise, i.e., back to a starting point of take-up operation. With compressed air supplied to the air cylinder 24, the cylinder rod 28 is pulled in, causing the rotating lever 20 to rotate clockwise, and consequently causing the take-up roll 14 to rotate for take-up operation. The stroke between the starting point of take-up and the point where the cylinder rod 28 is fully pulled in corresponds to take-up rotation angles $\theta_1$ and $\theta_2$ of the rotating lever, i.e., of the take-up roll 14 (see FIG. 5 and FIG. 6).

A sensor lever 32 is disposed at the side of the take-up roll 14, at the side of the line of stroke of the air cylinder 24, in order to measure the take-up diameter of the washing cloth 10 taken by the take-up roll 14. The sensor lever 32, at its top end, is rotatably supported by the axis of oscillation 34; the sensor lever 32 has, on its bottom side, a detector roller 36 which is projected toward the take-up roll 14 in a manner that the detector roller 36 is rotatably in contact with the take-up roll 14 surface. The mounting position of the detector roller 36 is so set up that, being kept parallel with the take-up roll 14, the detector roller 36 takes an orbit substantially along the radial direction of the take-up roll 14 along with the oscillation of the sensor lever 32. In an embodiment, the orbit is set up to agree with the line of the stroke of the air cylinder 24. Furthermore, a one-way spring 38 is disposed between the sensor lever 32 and the axis of oscillation 34, and, this spring 38 urges the detector roller 36 against the surface of the take-up roll 14.

The take-up stroke of the air cylinder 24 is determined by the take-up starting point where the cylinder rod 28 is fully pushed out and comes to a stop; to constrain the stroke, stroke constraint means is provided between the rotating lever 20 and the sensor lever 32. The stroke constraint means is made of a stopper 40 disposed on the sensor lever 32 and the stopper cam curvature portion 42 formed on the rotating lever 20.

As shown in FIG. 2, the stopper 40 is mounted on the other side of the sensor lever 32, opposed to the detector roller 36, on the bottom portion of the sensor lever 32, in a manner that the stopper 40 shares the common axis with the detector roller 36. The stopper 40 is projected across the plane of rotation of the rotating lever 20. Such an arrangement allows the stopper 40 to move together with the sensor lever 32 in accordance with the variations of the take-up diameter. The orbit of this movement is set substantially parallel with the direction of the stroke of the air cylinder 24 as already mentioned.

Figure 4:
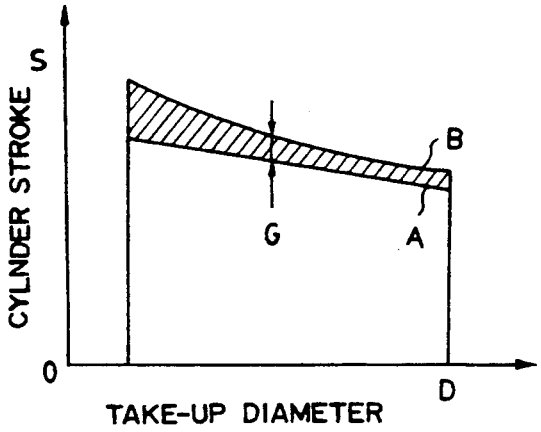
FIG. 4 is a graph showing a cam curvature portion.

The rotating lever 20 has, on its face toward the stopper 40, the cam curvature portion 42 of which configuration is designed to keep constant the take-up length at each position of the orbit which the stopper 40 takes, regardless of variations of the take-up diameter of the take-up roll 14. Specifically, when the take-up operation is in progress on the take-up roll 14, the cylinder stroke needs reducing as the take-up diameter increases, in order to continue taking up a regulated length of cloth. Required stroke of the air cylinder 24 is represented by line A, referenced to the point where the cylinder rod is fully pulled in, in FIG. 4, wherein the abscissa represents a take-up diameter D, and the ordinate represents the cylinder stroke. On the other hand, positional change of the stopper 40 which moves in response to variation of the take-up diameter is represented by line B. Therefore, the cam curvature portion 42 facing the stopper 40 is so configured that difference G is generated to make the take-up starting point of the air cylinder 24 agree with the required stroke line A in every take-up diameter D. In the above arrangement, the take-up starting point where the cylinder rod 28 is stopped by the stopper 40 is set up so that the rotating lever 20 is provided with a rotation angle which allows a regulated length of the washing cloth to be taken up at the current take-up diameter.

The regulated length take-up device constructed as above operates to take up the washing cloth 10 as below. When compressed air is supplied to the air cylinder 24 pushing in the cylinder rod 28 against the force of the spring 30, the rotating lever 20 rotates clockwise together with the cylinder rod 28, and stops at the point where the cylinder rod 28 is fully pushed in. The take-up roll 14 then rotates in its take-up direction, causing the washing cloth 10 to be taken up by a length corresponding to the current stroke of the air cylinder 24. The stopper 40 on the sensor lever 32 then comes off the cam curvature portion 42 of the rotating lever 20, and the sensor lever 32 is urged by the one-way spring 38 only so that the detector roller 36 is pressed against the surface of the take-up roll 14.

When the take-up operation finishes, feeding compressed air to the air cylinder 24 is stopped with compressed air inside released outward, the cylinder rod 28 is projected outward by the coil spring 30, causing the rotating lever 20 to rotate counterclockwise. The rotation of the rotating lever 20 is not transferred to the take-up roll 14 by means of the one-way clutch 22. At the moment the cam curvature portion 42 of the rotating lever 32 touches the stopper 40 disposed on the sensor lever 32, the rotating lever 20 comes to a stop. The sensor lever 32 is positioned at a point of its oscillation orbit determined by current take-up diameter by means of the detector roller 36. The same is true for the stopper 40. The cam curvature portion 42 of the rotating lever 20, which the stopper 40 touches, is so configured as to control the take-up starting point of the cylinder rod 28 in a manner that allows take-up stroke adaptable to variations of the take-up diameter. Therefore, the stop position of the rotating lever 20 constrains the take-up stroke of the air cylinder 24, and the required length of the washing cloth 10 is accurately taken up in the next take-up operation adapted to current take-up diameter, i.e., by push-in operation of the air cylinder 24. The take-up strokes for a minimum take-up diameter and a maximum take-up diameter are respectively shown in FIG. 5 and FIG. 6. In response to variations of the take-up diameter, the rotation angle adapted to varied diameter, such as $\theta_1$ and $\theta_2$, is provided, thereby allowing constant cloth payout L.

A reaction force which takes place when the rotating lever 20 is stopped by the stopper 40, is transferred to the axis of oscillation 34 of the sensor lever 32 via the stopper 40; however, this force on its line of action has no component force affecting the detector roller 36. In this case, source of the force then is the air cylinder 24 coil spring 30 only; strong force by the cylinder is not transferred to the sensor lever 32. The pressure the detector roller 36 exerts onto the take-up roll 14 is derived from the ordinary force by the one-way spring 38 only. The above arrangement does not induce excessive pressure which would make the detector roller 36 dent the lamination of the washing cloth 10 wound around the feeder roll. Proper pressure is thus maintained, allowing the take-up diameter to be accurately measured.

The push-in position of the air cylinder 24 adapted to the take-up diameter is thereafter automatically set up, thereby causing the washing cloth 10 to be always accurately taken up by a regulated length.

According to the embodiment of the present invention, the air cylinder 24 is disposed between the take-up roll 14 and the feeder roll 12, to control the push-in starting point. Thus, the width of the device is decreases, allowing the entire size of the device to be reduced. Since the detector mechanism for measuring the take-up diameter is not arranged on the line of action of pressure by the air cylinder 24, no cylinder force is transferred to the detector mechanism, thereby incurring no damage to the detector mechanism sensing capability.

In the above embodiment, the coil spring 30 is disposed around the cylinder rod 28. Alternatively, the coil spring 30 may be built in the cylinder. The mounting positions of the sensor lever 32 and the cam curvature portion 42 of the rotating lever 20 may be arbitrarily selected. The cam curvature 42 may be detachably mounted onto the rotating lever 20 as needed, in order to quickly comply with changes in operational parameters, such as thickness of the washing cloth 10.

I claim:

1. A regulated length take-up device for continually taking up a regulated length of sheet material around a take-up roll, comprising:

a rotating lever disposed on the take-up roll by means of a one-way clutch, take-up driving means, pivotably connected to the rotating lever, for rotating the take-up roll, a sensor lever positioned adjacent the take-up roll along a tangential direction of the take-up roll and pivoted about a pivot point according to variations in a take-up diameter of the take-up roll, and stroke constraint means for controlling a take-up stroke of the rotating lever in response to the variations in the take-up roll diameter so that the regulated length is kept constant, the stroke constraint means comprising:

a stopper attached to the sensor lever and extending in an axial direction of the take-up roll, and a cam curvature portion of the rotating lever, wherein the stopper prevents the rotating lever from rotating in a restoring direction in response to a stationary holding force, and a shape of the cam curvature portion is selected to transfer the stationary holding force applied to the rotating lever to the sensor lever through the stopper in a direction extending toward the pivot point, such that substantially no force is applied by the rotating lever to the sensor lever in a direction toward the take-up roll.

2. The regulated length take-up device according to claim 1, wherein the take-up driving means is a cylinder mechanism, movement of a supplied fluid rotating the rotating lever in a take-up direction to perform the take-up action, wherein a restoring spring provides a restoring movement to return the rotating lever in the restoring direction to a take-up starting point.

3. The regulated length take-up device according to claim 1, wherein the sensor lever has a detector roller positioned on a first side adjacent a free end of the sensor lever and contacting the surface of the take-up roll and a roller positioned on a second side adjacent the free end and forming the stopper, wherein both the detector roller and the roller are on a common axis.

4. The regulated length take-up device according to claim 1, wherein the sensor lever is urged by a one-way spring in a contact direction toward the take-up roll.

5. The regulated length take-up device according to claim 1 wherein the take-up driving means is so designed that the take-up starting point is adjusted by the stopper.

6. The regulated length take-up device according to claim 2, wherein the cylinder mechanism is so designed that its direction of stroke substantially agrees with the orbit of the stopper.

7. The regulated take-up device of claim 1, wherein the rotating lever is moved from a take-up position to a start position, the start position comprising the rotating lever being held against the stopper by the stationary holding force, the biasing means providing the stationary holding force.

8. The regulated take-up device of claim 7, wherein the start position varies as the stopper pivots about the pivot point in response to the take-up diameter.

9. A regulated length take-up device for continually taking up a regulated length of sheet material around a take-up roll, comprising:

a rotating lever disposed on the take-up roll by means of a one-way clutch, a cylinder mechanism pivotably connected to the rotating lever, a pull-in action of the cylinder mechanism causing the take-up roll to rotate in a take-up direction, and including a spring causing the take-up roll to rotate in a restoring direction, a sensor lever positioned adjacent a tangential direction of the take-up roll and capable of oscillating according to variations in a take-up diameter of the take-up roll, an orbit of oscillation of the sensor lever substantially aligned with a direction of stroke of the cylinder mechanism, a stopper positioned on the sensor lever and stopping the rotation of the rotating lever in the restoring direction, and the rotating lever including a cam curvature portion configured so that the regulating take-up length is kept constant regardless of variations of the take-up diameter and a position of the stopper along the orbit, wherein the cam curvature portion constrains the stroke of the cylinder mechanism and force components of the restoring rotation of the rotating lever act on the sensor lever through an axis of oscillation of the sensor lever.

* * * * *